United States Patent [19]

Hattori

[11] 3,969,792

[45] July 20, 1976

[54] BUCKLE FOR STRAPPING PARCEL OR THE LIKE WITH TAPE

[76] Inventor: Kenji Hattori, 6,9-Banchi, Miyamae-cho, Numazu, Shizuoka, Japan

[22] Filed: Feb. 18, 1975

[21] Appl. No.: 550,342

[30] Foreign Application Priority Data

Sept. 21, 1974 Japan ..... 49-108322
Oct. 4, 1974 Japan ..... 49-119362

[52] U.S. Cl. ..... 24/74 A; 24/193; 24/200

[51] Int. Cl.[2] ..... A44B 11/02; A44B 11/06

[58] Field of Search ..... 24/74 A, 193, 245 FF, 24/245 B

[56] References Cited

UNITED STATES PATENTS

| | | | |
|---|---|---|---|
| 2,781,569 | 2/1957 | Eilertsen | 24/246 |
| 3,139,662 | 7/1964 | Barton | 24/246 |
| 3,206,816 | 9/1965 | Vilcins | 24/200 |
| 3,336,639 | 8/1967 | Rutty | 24/74 A |
| 3,382,549 | 5/1968 | Price | 24/245 |
| 3,414,943 | 12/1968 | Hattori | 24/200 |

FOREIGN PATENTS OR APPLICATIONS

| | | | |
|---|---|---|---|
| 827,366 | 11/1969 | Canada | 24/74 A |
| 1,555,221 | 12/1968 | France | 24/200 |
| 932,484 | 10/1955 | Germany | 24/245 FF |
| 399,459 | 12/1931 | United Kingdom | 24/245 FF |

*Primary Examiner*—Bernard A. Gelak
*Attorney, Agent, or Firm*—George B. Oujevolk

[57] ABSTRACT

A buckle for fastening a tape around a package, comprising in combination a rectangular frame portion with four sides defining a plane, a flat leg portion also defining a plane and a flexible connecting portion connected to said leg portion and to one of said sides forming a rectangular space, said leg portion being folded at said connecting portion so as to be inserted in said space and supported by said leg portion so that the planes of both said frame portion and leg portion may be substantially flush with each other, whereby a fastening band can be pressed and fastened between said leg portion and said frame portion when it is wrapped around said leg portion and inserted in said space.

1 Claim, 14 Drawing Figures

PRIOR ART FIG. 7
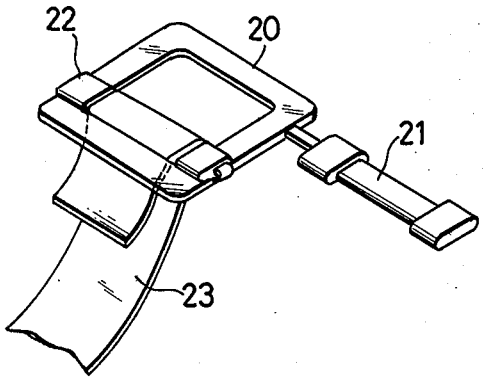
FIG. 9
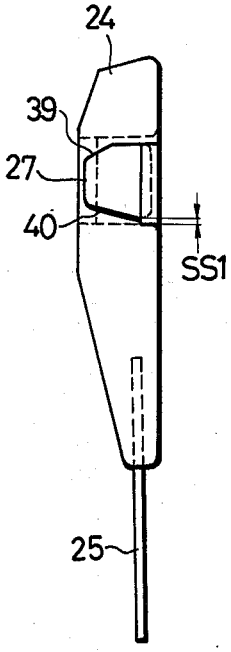
FIG. 11
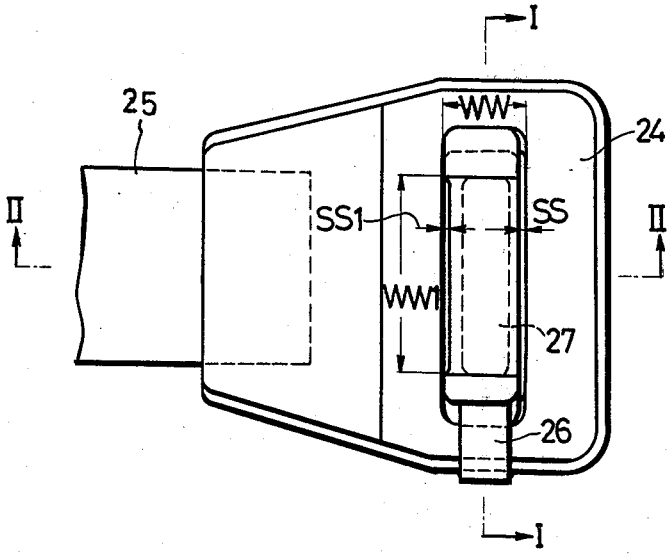

BUCKLE FOR STRAPPING PARCEL OR THE LIKE WITH TAPE

BACKGROUND OF THE INVENTION

This invention relates to a buckle for tightly fastening a tape or belt around a parcel or a similar object.

BRIEF REVIEW OF THE PRIOR ART

A conventional buckle of this type, such as the one described in U.S. Pat. No. 3,414,943 has a pair of parallel rods folded on a frame so that both ends of a tape may be bound around the rods to strap a parcel. In the case of this buckle, however, when the parcel is large and the tape must therefore be pulled strongly so as to be able to strap the parcel, one of the rods can slip, bend or even break in some cases because one end of each rod is placed on the frame only in a free condition. Also, as the rods are placed on the frame as stated above, the overall height of the buckle is big, and consequently, when parcels strapped with such buckles are stacked, the stack becomes unstable or other objects may collide against the projecting parts of the buckles and break the latter.

OBJECTS OF THE INVENTION

The present invention is made to eliminate these shortcomings of such a buckle for strapping a parcel or the like with a tape.

It is an object of this invention to provide a buckle for tightly strapping a parcel or a similar object with a tape.

Another object of this invention is to provide a buckle which will not allow a tape to slide or slip out of it after the tape has fastened a parcel or the like.

Still another object of this invention is to lessen the overall height of a conventional buckle of this type when the buckle is in a condition of strapping a parcel, thereby to improve the stability of strapped parcels when they are stacked and to minimize the possibilty of their contact with other objects.

SUMMARY OF THE INVENTION

Generally speaking, the present invention contemplates a buckle for fastening a tape around a package, comprising in combination a rectangular frame portion with four sides defining a plane, a flat leg portion also defining a plane and a flexible connecting portion connected to said leg portion and to one of said sides forming a rectangular space, said leg portion being folded at said connecting portion so as to be inserted in said space and supported by said leg portion so that the planes of both said frame portion and leg portion may be substantially flush with each other, whereby a fastening band can be pressed and fastened between said leg portion and said frame portion when it is wrapped around said leg portion and inserted in said space.

Two preferred embodiments of the present invention are shown in the accompanying drawings, wherein:

BRIEF DESCRIPTION OF THE DRAWINGS

FIG. 7 is a perspective view showing an example of conventional buckle of prior art;

FIGS. 9 and 10 are side view of the same embodiment shown in FIG. 8;

FIG. 11 is an elevational view of the buckle of the same embodiment as folded;

DETAILED DESCRIPTION

Figure 1:
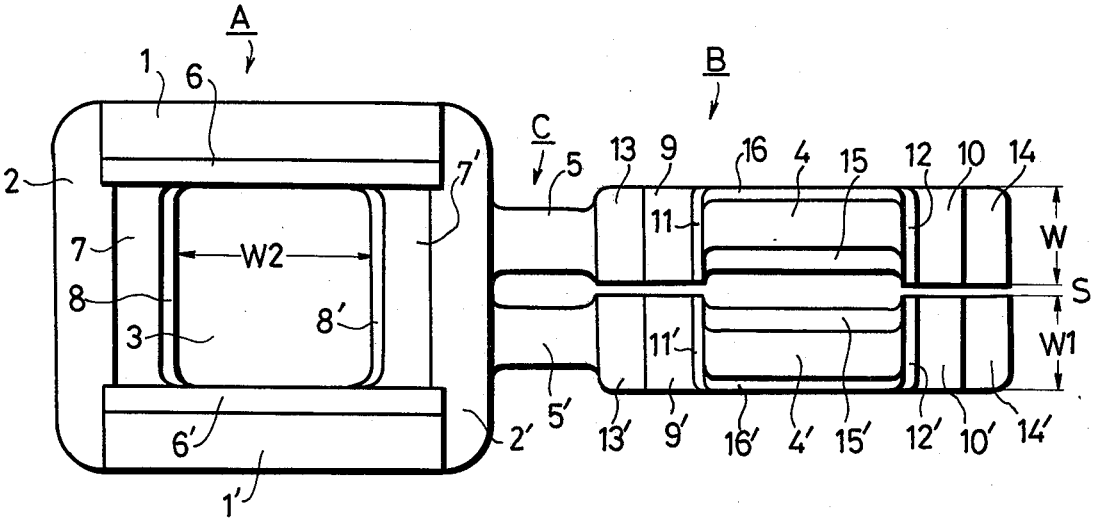
FIG. 1 is an elevational view of the buckle of this invention as developed.
Figure 2:
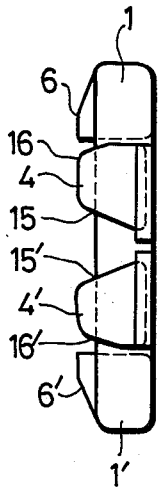
FIGS. 2 and 3 are side view of the buckle shown in FIG. 1.
Figure 4:
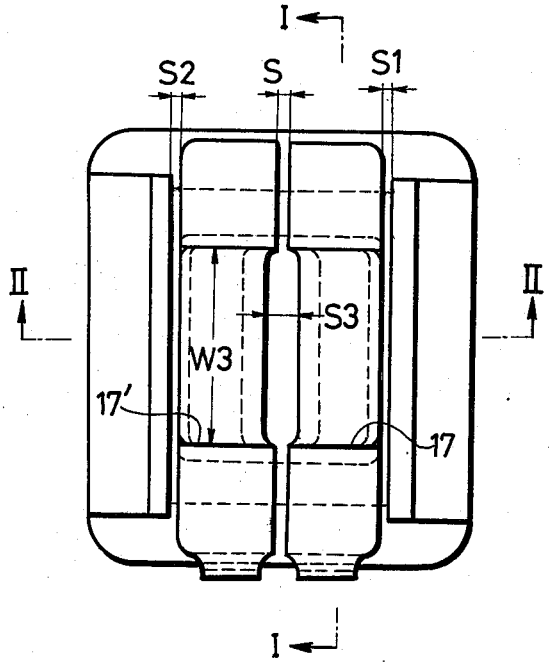
FIG. 4 is an elevational view of the buckle shown in FIG. 1 as folded.
Figure 3:
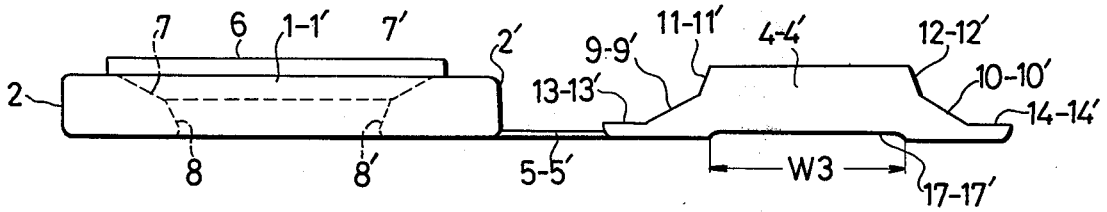
Figure 5:
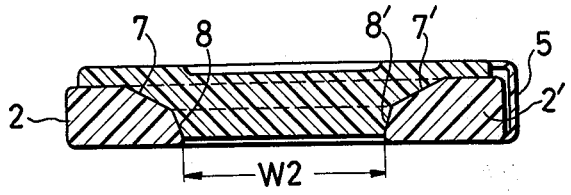
FIG. 5 is a sectional view taken along the line I—I in FIG. 4.
Figure 6:
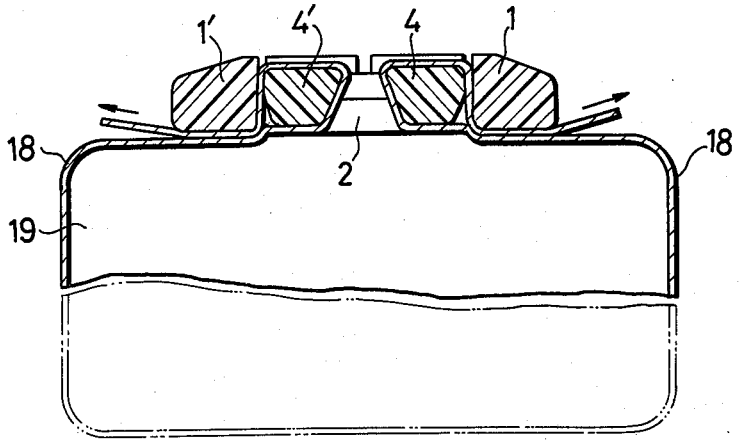
FIG. 6 is a sectional view taken along the line II—II in FIG. 4.

Referring now to the accompanying drawings, the embodiment of the buckle according to this invention comprises a framed portion A, a leg portion B and a connecting portion C. Framed portion A is a rectangular frame consisting of two pairs of parallel sides 1, 1' and 2, 2' and having a similarly rectangular aperture 3 in the middle.

Leg portion B consists of a pair of parallel legs 4 and 4'. Connecting portion C consists of a pair of parallel connecting members 5 and 5' and connects legs 4 and 4' to side 2' of framed portion A respectively with connecting members 5 and 5'. Said framed portion A, leg portion B and connecting portion C are formed integrally into one body of plastics having adequate strength and elasticity.

The construction of each of the portions will be described hereinafter in further detail. Of framed portion A, parallel sides 1 and 1' are formed respectively with angular projections 6 and 6', said projections 6 and 6' being inclined toward the outside of sides 1 and 1' leaving narrow flat planes which are slightly higher than the surfaces of sides 2 and 2' along those edges of sides 1 and 1' which are facing the aperture 3 and somewhat protruding further beyond said edges on both sides, and aperture 3 is formed with the inclined planes 7, 7' and 8, 8' of parallel sides 2 and 2', said inclined planes being inclined toward the inside of sides 2 and 2'.

Widths W and W1 of legs 4 and 4' of said leg portion B are selected in such a manner that, when legs 4 and 4' are folded at connecting members 5 and 5' toward the front side of framed portion A, some spaces S, S1 and S2 (each about 1mm in the case of the present embodiment) will be made between legs 4 and 4' and between legs 4 and 4' and said projections 6 and 6'. Legs 4 and 4' are formed with inclined convex planes 9, 9' and 10, 10' and also with flat planes 13, 13' and 14, 14', said inclined convex planes 9, 9' and 10, 10' being capable of fitting inclined planes 7, 7' and 8, 8' of sides 2 and 2' of framed portion A and said flat planes 13, 13' and 14, 14' being capable of connecting the surfaces of sides 2 and 2' when legs 4 and 4' are fitted into aperture 3 of framed portion A. Also, legs 4 and 4' are formed with groove-like recesses 17 and 17' in their bottom at right angles to the directions of their parallel arrangement and with width W3 nearly equal to width W2 of aperture 3 of framed portion A. The depth of said recesses 17 and 17', which nearly corresponds to the thickness of the strapping tape to be described later, is about 1mm in the case of this embodiment. The top longitudinal width of legs 4 and 4' is equal to said width W2 of aperture 3.

Furthermore, legs 4 and 4' are formed with upwardly inclined planes 15 and 15' on their confronting sides and also with upwardly inclined planes 16 and 16' on their other sides leaving some flat planes. Legs 4 and 4 have space S3 between their confronting planes, said space S3 being somewhat wider than said about 1mm space S (about 3mm in the case of this embodiment).

Connecting members 5 and 5' of connecting portion C are relatively thin and have widths somewhat smaller than widths W and W1 of legs 4 and 4'. Said connecting members 5 and 5' connect framed portion A and leg portion B at the bottom of framed portion A and at the bottom of legs 4 and 4'.

As the buckle of this invention is composed as described above, when legs 4 and 4' are bent at connecting members 5 and 5' toward framed portion A and pushed into aperture 3, inclined convex planes 9, 9' and 10, 10' come in tight contact with inclined planes 7, 7' and 8, 8', with the result that spaces S1 and S2 are formed between both edges of legs 4 and 4' and sides 1 and 1' of framed portion A and spaces S and S3 between the confronting planes of legs 4 and 4'. Thus the flat planes 13, 13' and 14, 14' of legs 4 and 4' come in tight contact with the flat planes of sides 2 and 2' of framed portion A, so that legs 4 and 4'are spanned over aperture 3.

The buckle of this invention is so constructed that framed portion A and leg portion B may be fitted together by being bent in a folded condition at connecting portion C as described above. How a parcel or like object is strapped with a tape or band-like object by the buckle will be described hereunder with regard to a case in which band 18 is used for strapping the parcel. First of all, it should be understood that band 18 to be used on the buckle of this invention is made of plastics having adequate strength and elasticity and shaped flat, and that its width and thickness nearly correspond to those of groove-like recesses 17 and 17' of legs 4 and 4'. When one end of band 18 is inserted in the buckle of this invention from under side 1 of framed portion A toward aperture 3 and leg 4 is folded at connecting member 5 toward the front side of framed portion A and then said end of band 18 which has been inserted from under side 1 is passed through recess 17, wound around leg 4, extracted from between the bottom of side 1 and band 18 and pulled in direction of arrow, said end of band 18 is tightly fastened by side 1 and leg 4. Next, when parcel 19 is surrounded by band 18, the other end of tape 18 is inserted in the buckle from under side 1' of framed portion A toward aperture 3 and then said end of band 18 which has been inserted from under side 1' is passed through recess 17', wound around leg 4', extracted from between the bottom of side 1' and band 18 and pulled in direction of arrow all in the same manner as above, the other end of band 18 is tightly fastened by side 1' and leg 4' and parcel 19 is thereby tightly strapped with band 18.

Figure 8:
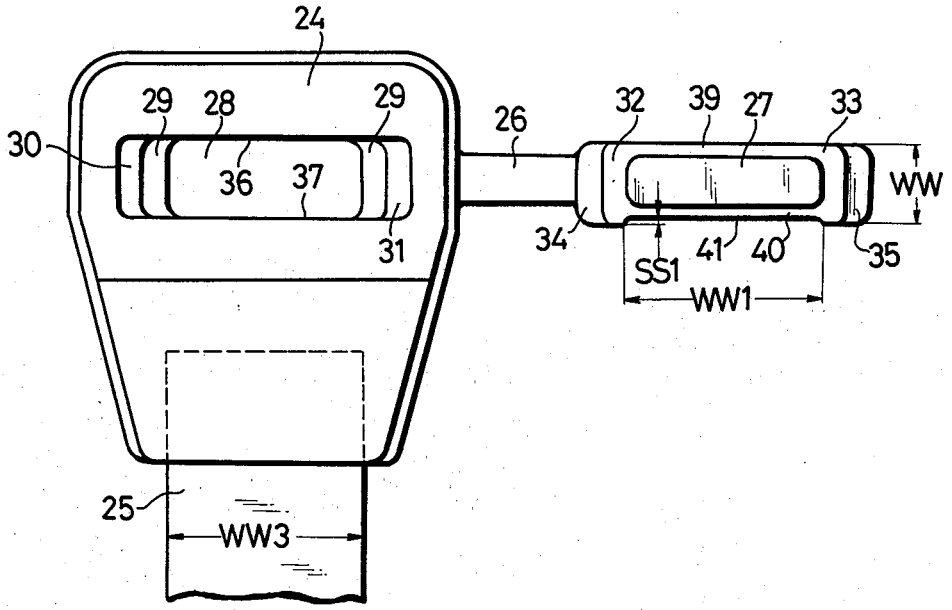
FIG. 8 is an elevational view of the buckle of another embodiment of this invention as developed.
Figure 10:
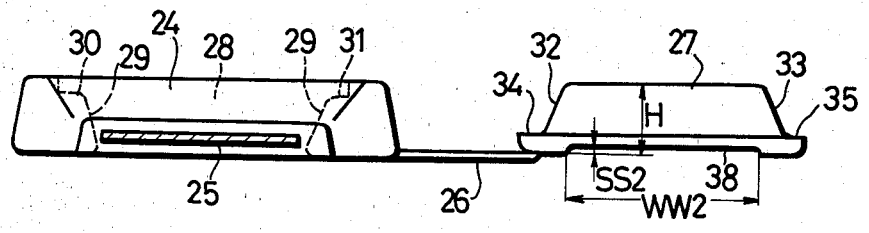
Figure 12:
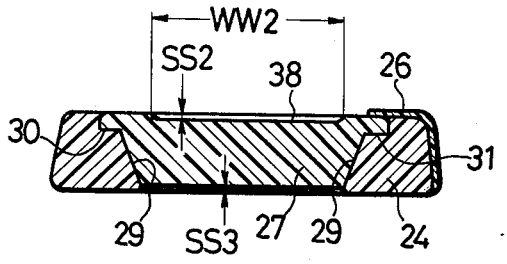
FIG. 12 is a sectional view of the buckle taken along the line I—I in FIG. 11.
Figure 13:
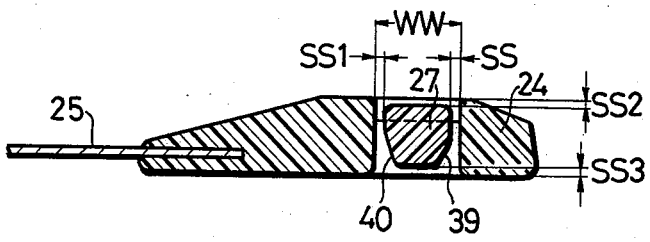
FIG. 13 is a sectional view taken along the line II—II in FIG. 11.
Figure 14:
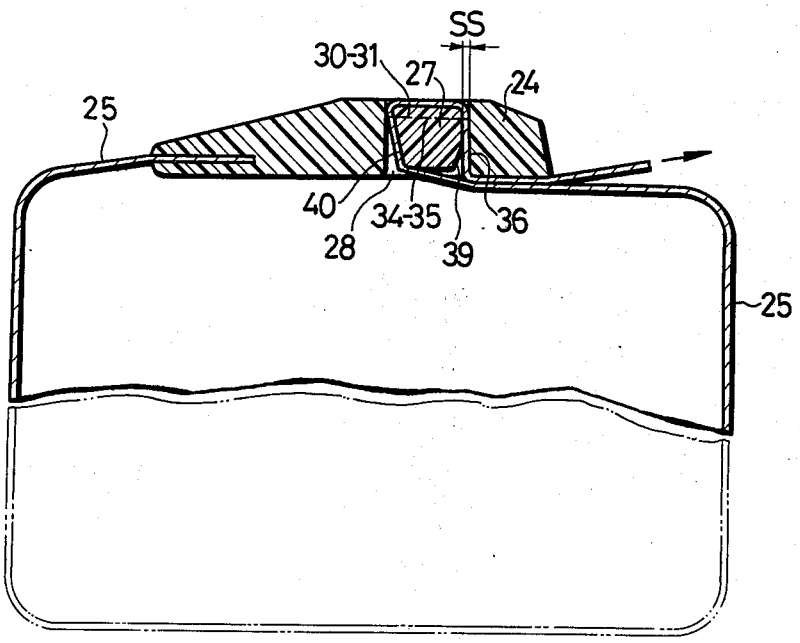
FIG. 14 is a sectional view of the buckle of the same embodiment showing a fastening condition thereof.

FIGS. 8 through 14 show another embodiment of the present invention showing a stopper frame 24, in which one end of band is tightly embedded in the stopper frame, and the free end of said band is tightened with stopper frame and leg inserted therein so that a parcel is strapped. Said frame 24 is formed with inclined aperture 28 of inclined planes 29, 29 which are oblong in the directions longitudinal and rectangular to band 25 and convergent in the direction to the bottom thereof.

And both longitudinal sides of this inclined aperture 28 are flat planes 36 and 37 parallel to each other, and parts of the upper portion of both sides of said inclined planes 29, 29 of said inclined aperture 28 are formed with flat planes 30 and 31.

Leg portion 27 is provided with inclined planes 32 and 33 which, in case of leg portion being inserted in said inclined aperture 28, may mate with inclined planes 29 and 29 of framed portion 24, and also provided with flat planes 34 and 35 which will come in contact with flat planes 30 and 31. Also, leg portion 27 is formed with such width WW that, when inserted in said inclined aperture 28, there will be space SS, width WW1 and space SS1 between flatplanes 36, 37 and said leg portion, and provided with groove-like recess 38 having width WW1 and space SS2. Furthermore, leg portion 27 is formed with such depth that there may be space SS3 between the bottom and top surfaces of framed portion 24. Leg portion 27 is further formed with planes 39 and 40, each inclined downwardly so as to confront said inclined planes 36 and 37 when inserted in said inclined aperture 28.

Connecting portion 26 is of adequate strength and elasticity and connects the bottom surface of framed portion 24 with leg portion 27 of their bottom portion of reduced thickness.

The above-mentioned frame portion 24, leg portion 27 and connecting portion 26 are formed integrally into one unit of plastics having adequate strength and elasticity.

Spaces SS, SS1 and SS2 are each conformable to the depth of band 25, and widths WW1 and WW2 are also conformable to width WW3 of band 25.

Next, there will be explained how to strap a parcel and the like by using band 25 such as described above. The free end of band 25 which has been wrapped around parcel 19 is inserted in said inclined aperture 28 from the under side of the bottom of framed portion 24 and drawn upwardly. Leg portion 27 is then folded over framed portion 24 at connecting portion 26, and the free end of said band 25 is wrapped around leg portion 27, when band 25 is guided in contact with each of recesses 41 and 38 which serve as guiding portions for band 25, said free end being further inserted in space SS so as to be drawn outwardly in the direction indicated by arrow from under framed portion 24, simultaneously inserting leg portion 27 in inclined aperture 28 of framed portion 24 so that inclined planes 32 and 33 of leg portion 27 may come in contact with inclined planes 28 and 29, and also flat planes 34 and 35 may come in contact with flat planes 30 and 31 of framed portion 24 so as to be supported thereon, thus tightly strapping the parcel by means of band 25 (see FIG. 14). After the parcel has been strapped, leg portion 27 may, due to its having inclined plane 40, be pulled toward flat plane 36 by band 25, so that band 25 passing through space SS will be tightly fastened, said band 25 being sandwiched between framed portion 24 and leg portion 27.

The present invention composed and functioning as described above in detail has the following advantages.

1. As leg portion is housed in framed portion, to be more precise, in aperture of said portion when parcel is in a condition of being strapped with band, the buckle as a whole becomes lower than a conventional buckle of this type. Therefore, when strapped parcels are to be stacked, a more stable stack can be obtained because the buckles scarcely prove to be obstructive and there is less possibility the buckles breaking due to contact with external objects.

2. When parcel is in a condition of being strapped with band, legs are fitted tightly to sides of framed portion in aperture and the longitudinal outer sides of legs come in tight contact with sides of framed portion via band. Legs are therefore free from the unsteadiness of the legs of a conventional buckle and do not break when band is subjected to strong tension.

3. When parcel is in a condition of being strapped with band, legs have their inclined convex planes supported by inclined planes of sides of framed portion. Therefore, legs do not break or bend when band wound around legs is strongly pulled.

4. As band is fitted in groove-like recesses of legs and guided by said recesses when fastened tightly, band do not slip aside or out of legs.

FIG. 7 shows a buckle of the prior art as shown in U.S. Pat. No. 3,414,943 having a pair of parallel rods 21 and 22 folded on a frame 20 so that both ends of a tape 23 may be bound around the rods 21 and 22 to strap a parcel.

It should be understood that the two preferable embodiments of this invention disclosed herein with reference to the accompanying drawings are of an illustrative character and are not restrictive and that various changes and modifications in design and construction may be made without departing from the scope and spirit of this invention.

I claim:

1. In a buckle for strapping packages having a rectangular frame portion (A) with one pair of lateral parallel sides (1, 1'), a pair of end sides (2, 2') with a rectangular aperture (3) in the center, a leg portion (B) having a pair of parallel legs (4, 4') and a connecting portion (C) having a pair of parallel connecting members (5, 5') connecting said legs (4, 4') and one of said end sides (2'), in combination: angular projections (6, 6') on said lateral sides (1, 1') inclined toward the outside of said lateral sides leaving narrow flat planes slightly higher than the surfaces of said end sides (2, 2') along those edges of said lateral sides (1, 1') facing the rectangular aperture (3), said aperture (3) being formed with inclined planes (7, 7', 8, 8') of said end sides (2, 2'), said inclined planes being inclined toward the inside of said end sides (2, 2'), the width (W, W1) of said legs (4, 4') being selected so that when said legs (4, 4') are folded at said connecting members (5, 5') toward the framed portion (A) some spaces (S, S1, S2) will be left between said legs (4, 4') and said projections (6, 6'), said legs (4, 4') being formed with inclined convex planes (9, 9', 10, 10') and also with flat planes (13, 13', 14, 14'), said inclined convex planes (7, 7', 8, 8') of said end sides (2, 2') and said flat planes (13, 13', 14, 14') being capable of connecting the surfaces of said end sides (2, 2') when said legs (4, 4') are fitted into said rectangular aperture (3), said legs moreover having groove-like recesses (17, 17') in their bottom at right angles to the directions of their parallel arrangement and a width (W3) nearly equal to the width (W2) of the rectangular aperture (3), the depth of said recesses (17, 17') nearly corresponding to the thickness of a strapping tape the top longitudinal width of said legs (4, 4') being equal to the width (2) of said aperture (3), said legs (4, 4') being formed with upwardly inclined planes (15, 15') on their confronting sides and also with upwardly inclined planes (16, 16') on their other sides leaving some flat planes, said legs (4, 4') having a space between confronting planes, the connecting members (5, 5') being relatively thin and having widths somewhat smaller than the widths (W, W1) of the legs (4, 4') so that when the legs (4, 4') are bent at the connecting members (5, 5') toward the aperture (3), the inclined convex planes (9, 9', 10, 10') come into tight contact with the inclined planes (7, 7', 8, 8') and the flat planes (13, 13', 14, 14') of said legs (4, 4') come into tight contact with the flat planes of said end sides (2, 2') and said legs (4, 4') span over the aperture (3).

* * * * *